US007506670B2

(12) United States Patent
Hay

(10) Patent No.: US 7,506,670 B2
(45) Date of Patent: Mar. 24, 2009

(54) PAPER MACHINE FABRIC

(75) Inventor: Stewart Lister Hay, Ramsbottom Lancashire (GB)

(73) Assignee: Voith Paper Patent GmbH (DE)

( * ) Notice: Subject to any disclaimer, the term of this patent is extended or adjusted under 35 U.S.C. 154(b) by 444 days.

(21) Appl. No.: 10/564,990

(22) PCT Filed: May 12, 2004

(86) PCT No.: PCT/EP2004/050775

§ 371 (c)(1),
(2), (4) Date: Jan. 18, 2006

(87) PCT Pub. No.: WO2005/014926

PCT Pub. Date: Feb. 17, 2005

(65) Prior Publication Data

US 2006/0243339 A1 Nov. 2, 2006

(30) Foreign Application Priority Data

Jul. 24, 2003 (GB) ..... 0317248.3

(51) Int. Cl.

| | |
|---|---|
| ***D03D 3/04*** | (2006.01) |
| ***D21F 7/08*** | (2006.01) |
| ***D21F 7/12*** | (2006.01) |
| *D21F 7/00* | (2006.01) |
| *D03D 25/00* | (2006.01) |

(52) U.S. Cl. ..... 139/383 A; 139/383 R; 162/358.2

(58) Field of Classification Search ..... 139/383 A, 139/383 R; 442/203, 206, 207; 162/358.2, 162/900, 903

See application file for complete search history.

(56) References Cited

U.S. PATENT DOCUMENTS

| | | | | |
|---|---|---|---|---|
| 4,228,829 | A * | 10/1980 | Kikuchi | 139/408 |
| 4,453,573 | A * | 6/1984 | Thompson | 139/383 A |
| 4,501,303 | A * | 2/1985 | Osterberg | 139/425 A |
| 4,515,853 | A * | 5/1985 | Borel | 442/205 |
| 4,529,013 | A * | 7/1985 | Miller | 139/383 A |

(Continued)

FOREIGN PATENT DOCUMENTS

| | | |
|---|---|---|
| EP | 1 000 197 A1 | 5/2000 |
| EP | 1158090 | 11/2001 |
| EP | 1 000 197 B1 | 6/2002 |
| EP | 1273698 | 1/2003 |

OTHER PUBLICATIONS

PCT/EP2004/050775 Written Opinion PCT/ISA/237.

*Primary Examiner*—Bobby H Muromoto, Jr.
(74) *Attorney, Agent, or Firm*—Hershkovitz & Associates, LLC; Abraham Hershkovitz

(57) ABSTRACT

A paper machine fabric has a paper side warp layer and a machine side warp layer. The fabric comprises at least one set of paper side wefts interlaced with the paper side warps and at least one set of machine side wefts interlocked with the machine side warps. The fabric further comprises at least one pair of interchanging weft binders, the members of each weft binder pair together forming one continuous weft path on the paper side, each of said members of all of said weft binder pairs interweaving with at least one paper side warp and at least one machine side warp. At least one weft binder yarn of at least one binder pair interlocks in an unlocked position with at least one warp yarn of the machine side of the fabric.

15 Claims, 2 Drawing Sheets

U.S. PATENT DOCUMENTS 4,564,052 A * 1/1986 Borel ..... 139/425 A
4,592,395 A * 6/1986 Borel ..... 139/383 A
4,605,585 A * 8/1986 Johansson ..... 442/2
4,611,639 A * 9/1986 Bugge ..... 139/383 A
4,633,596 A * 1/1987 Josef ..... 34/116
4,636,426 A * 1/1987 Fleischer ..... 442/149
4,642,261 A * 2/1987 Fearnhead ..... 442/207
4,676,278 A * 6/1987 Dutt ..... 139/383 AA
4,729,412 A * 3/1988 Bugge ..... 139/383 A
4,909,284 A * 3/1990 Kositzke ..... 139/383 A
4,934,414 A * 6/1990 Borel ..... 139/383 A
4,941,514 A * 7/1990 Taipale ..... 139/383 A
4,942,077 A * 7/1990 Wendt et al. ..... 428/152
4,945,952 A * 8/1990 Vohringer ..... 139/383 A
4,987,929 A * 1/1991 Wilson ..... 139/383 A
4,989,647 A * 2/1991 Marchand ..... 139/383 A
4,998,568 A * 3/1991 Vohringer ..... 139/383 A
5,074,339 A * 12/1991 Vohringer ..... 139/383 A
5,092,372 A * 3/1992 Fitzka et al. ..... 139/383 A
5,101,866 A * 4/1992 Quigley ..... 139/383 A
5,116,478 A * 5/1992 Tate et al. ..... 162/358.2
5,152,326 A * 10/1992 Vohringer ..... 139/383 A
5,219,004 A * 6/1993 Chiu ..... 139/383 A
5,228,482 A * 7/1993 Fleischer ..... 139/383 A
5,358,014 A * 10/1994 Kovar ..... 139/383 A
5,421,374 A * 6/1995 Wright ..... 139/383 A
5,454,405 A * 10/1995 Hawes ..... 139/383 A
5,487,414 A * 1/1996 Kuji et al. ..... 139/383 A
5,518,042 A * 5/1996 Wilson ..... 139/383 A
5,564,475 A * 10/1996 Wright ..... 139/383 A
5,709,250 A * 1/1998 Ward et al. ..... 139/383 A
5,826,627 A * 10/1998 Seabrook et al. ..... 139/383 A
5,967,195 A * 10/1999 Ward ..... 139/383 A
6,145,550 A 11/2000 Ward
6,745,797 B2 * 6/2004 Troughton ..... 139/383 A
6,837,277 B2 * 1/2005 Troughton et al. ..... 139/383 A
6,854,488 B2 * 2/2005 Hay et al. ..... 139/383 A
6,860,969 B2 * 3/2005 Troughton ..... 162/348
6,896,009 B2 * 5/2005 Ward ..... 139/383 A
6,905,574 B2 * 6/2005 Festor ..... 162/348
6,920,902 B2 * 7/2005 Majaury et al. ..... 139/383 A
6,959,737 B2 * 11/2005 Ward ..... 139/383 A
6,978,809 B2 * 12/2005 Quigley ..... 139/383 A
7,007,722 B2 * 3/2006 Quigley et al. ..... 139/383 A
7,059,357 B2 * 6/2006 Ward ..... 139/348
7,243,687 B2 * 7/2007 Barratte ..... 139/383 A
7,275,566 B2 * 10/2007 Ward ..... 139/383 A
7,357,155 B2 * 4/2008 Fahrer et al. ..... 139/383 A
7,357,157 B2 * 4/2008 Ueda ..... 139/383 A

* cited by examiner

PAPER MACHINE FABRIC

CROSS-REFERENCE TO RELATED APPLICATIONS

The present application claims priority under 35 U.S.C. 119 of GB 0317248.3 filed 24 Jul. 2003.

BACKGROUND OF THE INVENTION

1. Field of the Invention

The present invention relates to paper machine fabrics, and particularly but not exclusively to forming fabrics for use in the forming section of a papermaking machine.

2. Discussion of Background Information

Paper is conventionally manufactured by conveying a paper furnish, usually consisting of an initial slurry of cellulosic fibers, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder and then creped.

Paper machine clothing is essentially employed to carry the paper web through these various stages of the papermaking machine. In the forming section the fibrous furnish is wet-laid onto a moving forming wire and water drainage from it is assisted by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. In the final stage, the paper web is transferred either to a Yankee dryer, in the case of tissue paper manufacture, or to a set of dryer cylinders upon which, aided by the clamping action of the dryer fabric, the majority of the remaining water is evaporated.

So called "triple layer" paper machine fabrics are known in the art. These generally comprise paper side and machine side warp and weft yarn systems, which are bound together by binder yarns.

EP 1,000,197A and EP 1,158,090A both disclose triple layer fabric in which the paper side weave is obtained by the interweaving of paper side machine direction (MD) or warp yarns with both individual, non-interchanging, paper side weft yarns and interchanging pairs of weft yarns which, in addition to forming part of the paper side weave, also act to bind the paper side and 5 wear side fabrics together.

While structures made according to EP 1,000,197A and EP 1,158,090A have given good performance, in some respects, they have been found to be rather high in thickness such that water carried within the fabric void space may, near the end of the paper machine's sheet forming section, rewet the paper sheet resulting in decreased machine efficiency. EP 1,273,698A seeks to resolve this issue by incorporating thinner MD and CD (cross machine direction) yarns such that thinner fabrics containing less void space are provided. While this approach is helpful in resolving the so-called "sheet rewet" issue it creates a new problem in that the finer fabric has reduced CD bending stiffness and consequently the less stable fabric has a decreased ability to minimize sheet basis weight profiles.

The present invention has been made from a consideration of these problems.

SUMMARY OF THE INVENTION

According to the present invention there is provided a paper machine fabric having a paper side warp layer and a machine side warp layer, the fabric comprising at least one set of paper side wefts interlaced with the paper side warps, at least one set of machine side wefts interlaced with the machine side warps and at least one pair of interchanging weft binders, the members of each welt binder pair together forming one continuous welt path on the paper side, all of said waft binder pairs interweaving with at least one paper side warp and at least one machine side warp, wherein at least one weft binder yarn member of at least one binder pair interlaces in an unlocked position with at least one warp yarn of the machine side of the fabric.

An unlocked binder position under a warp yarn of the machine side or so called "wearside" fabric is one that is not enclosed on all sides by the Interlacing of_wearside fabric warp and weft yarns. Conversely, when a binding weft interlaces with a warp of the wearside fabric and that binding is contiguous to the interlacings of wearside fabric warp and weft on each side then the binder knuckle position is referred to as locked because the proximity of the contiguous machine direction—cross machine direction (MD-CD) interlacings maintain, or lock, the said binder knuckle in that position such that it is not free to move during the fabric manufacturing process.

Surprisingly, it has been found in fabrics with a "regular sateen" machine side weave pattern, that a significant increase in fabric CD bending stiffness can be achieved when the binder yarns are not locked in position by the interlacing of contiguous MD and CD yarns of the wearside fabric. Thus with the fabrics of the present invention the binder position relative to the interlacings of the warp and weft yarns in the machine side fabric facilitates a significant increase in fabric bending stiffness and thus the ability of the fabric to control sheet basis weight profiles.

In the preferred fabric of the present invention the machine side wefts interlace with the machine side warps in a regular sateen order to enable ease of suitable binder knuckle positioning. A regular sateen weave is herein defined as a weave containing all of the following features:

- the functional surface of the fabric is dominated by weft floats;
- fabric MD-CD interlacings are spaced at regular distances from each other;
- no two MD-CD interlacings are contiguous;
- there is only one warp interlacing with each weft in the weave pattern repeat;
- all the floats of all MD yarns are of equal length;
- all the floats of all CD yarns are of equal length.

Regular sateen weaves are utilized as opposed to irregular, modified, or extended sateen weaves due to the ease with which binder knuckles can be distributed. Where sateen weaves are referred to in the remainder of the application it is to be understood that the weave in question belongs to the regular category.

Preferred wear side fabric sateen weaves include 5, 7, 8, or 10 shaft sateens and preferred fabric total warp repeat size may include 20 or 40 shaft, 28 shaft, 16 or 32 shaft by way of non-limiting examples which allow for multiple wearside and paper side fabric weave repeats to thereby give more options regarding the placement of binder knuckles in the wearside fabric.

In a preferred embodiment of the invention all binder pairs comprise a binder yarn which interlaces with machine side warp in unlocked positions. In an alternative embodiment half of the binder pairs comprise a binder yarn which interlaces with the machine side warp in unlocked positions.

In one preferred embodiment the paper side weave pattern is selected from the group including 3, 4, 5, 6 shaft straight or broken twill, or regular or irregular sateen or other modified weave giving a paper side weave where weft floats extend over two or more adjacent paper side warp yarns.

In an alternative embodiment the paper side weave pattern is plain weave. In this embodiment, in particular, the machine side weave pattern is ideally selected from the group including 5, 7, 8 and 10 shaft sateen.

In a preferred embodiment of the invention the ratio of paper side to machine side weft yarns, when counting a pair of interchanging wefts as a single paper side weft, is selected from the group including 1:1, 2:1, 3:2, 4:3, 5:3.

Ideally the ratio of paper side to machine side warp yarns is selected from the group including 1:1, 2:1, 3:2, 4:3, 5:3.

The interchanging weft binders may be positioned between and adjacent non-interchanging paper side wefts.

In one embodiment interchanging weft binders are positioned in the paper side fabric such that all paper side weft yarns are separated by a pair of interchanging binder wefts. Alternatively interchanging weft binder pairs may be positioned such that groups of two, three or more contiguous paper side weft yarns occur between each interchanging weft binder pair and the size of the contiguous paper side weft yarn groups are identical through the full fabric weave repeat. Alternatively interchanging weft binders may be positioned such that the number of contiguous paper side weft yarns occurring between successive interchanging weft binder pairs varies between at least three successive interchanging weft binder pairs in the fabric weave repeat.

In a preferred embodiment interchanging binder pairs and paper side weft yarns occur in equal numbers. In a further preferred embodiment interchanging weft binder pairs are less numerous than the paper side weft yarns. In another embodiment interchanging binder pairs are more numerous than the paper side weft yarns.

The paper is made by depositing paperstock on the papermaking side of the fabric of the invention and then dewatering the paperstock. The invention is primarily aimed at relatively fine and thin fabric with paper side warp diameter in the range of 0.10 to 0.14 mm and with machine side warp diameter in the range of 0.15 to 0.19 mm. However, the benefits of the invention may be realized in fabric utilizing thicker warp yarns of up to, for example, 0.25 mm on the paper side and up to 0.30 mm on the wear side. Although yarns are described as having diameter the invention can be realized with weft and/or warp yarns of non-circular cross-section such oval, square, or rectangular. The yarn materials may be monofilament or multifilament and can be made from such materials as polyester and polyamide. Optionally the insertion order of the interchanging weft pair can be carried out such that the yarns "reverse". Such reversing to re-distribute relative yarn knuckle positions in the paper side fabric are known in the art.

In order that the present invention may be more readily understood, specific embodiments thereof will now be described by way of illustration only with reference to the accompanying drawings in which:

DETAILED DESCRIPTION OF THE INVENTION

Figure 1:
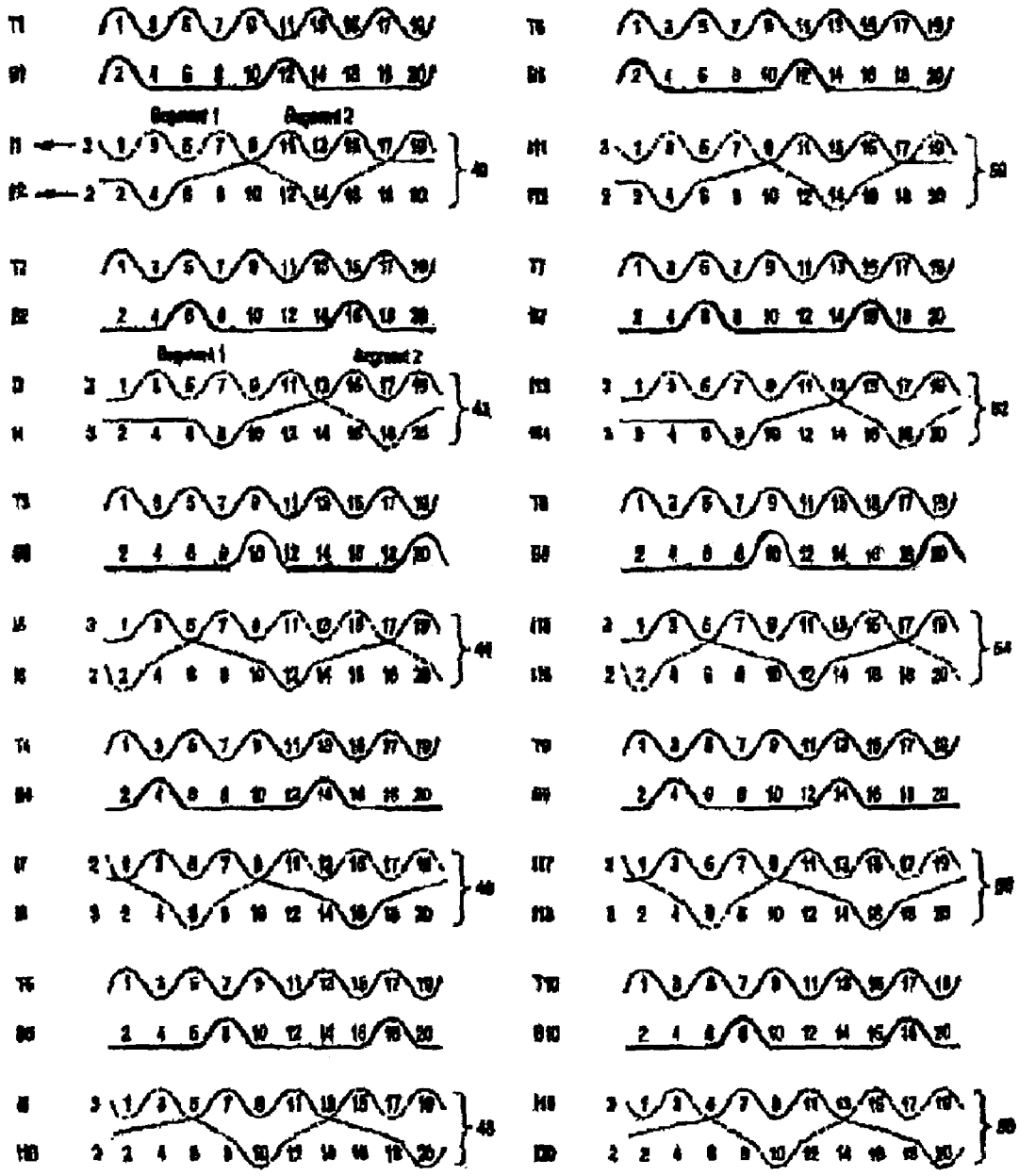
Fig.1 PRIOR ART
FIG. 1 shows a series of warp cross-sectional diagrams showing the consecutive weft paths of a fabric in accordance with the prior art EP 1,000,1 97A and EP 1,158,090A.

Referring to FIG. 1 a fabric in accordance with the prior art has a twenty warp yarn repeat wherein warp yarns 1, 3, 5 . . . 19 are paper side warp yarns and warp yarns 2, 4, 6 . . . 20 are wearside warp yarns. The fabric of FIG. 1 also contains a forty weft repeat. The wefts comprise paper side or top wefts T1, T2, T3 . . . T10, wear side or bottom wefts B1, B2, B3 . . . B10 and interchanging binder weft pairs 40, 42, 44 . . . 58.

A high value for fabric CD bending stiffness is desirable to increase the fabric ability to minimize sheet basis weight profiles. Fabric according to FIG. 2 may allow some movement of the binder yarns such that they may ride at least partially on an adjacent wear side in accordance weft yarn, as indicated by a thickness increase of 2.4% compared to fabric according to FIG. 1, such that bending resistance increases.

Still referring to FIG. 1, interchanging weft yarns I1 and I2 are both binder yarns in the pair 40 and interlace respectively with warp yarns 14 and 4 of the wear side fabric. Both binder yarns are positioned between wear side wefts B1 and B2. The interlacing of weft B1 with warp 12 and weft B2 with warp 16 acts to "lock" binder I1 in position in the wearside fabric where it interlaces with warp 14 such that the binder knuckle will fit snugly into this area and will not move during manufacture. Similarly the interlacing of weft B1 with warp 2 and weft B2 with warp 6 acts to lock binder I2 in position. The binding arrangement of interchanging binders I1 and I2 is representative of the other binder pairs, as can be seen in FIG. 1, so these are not described further. The interlacing of the respective wear side weft and warp yarns acts to form a five shaft wear side fabric with the characteristic weft path moving under four adjacent warps and over one warp arrangement, for example weft B1 moves over warp 2 and under adjacent warps 4, 6, 8, & 10 to give a first five shaft repeat before moving over warp 12 and under adjacent warps 14, 16, 18, 20 to give a second five shaft repeat. All of the weft floats in the wearside fabric are of equal length, i.e. under 4 warp yarns, as indeed are the warp floats. The interlacings of warp yarns with adjacent wefts in the wear side cloth are not contiguous but Instead are separated by a regular number of warp yarns, for example, weft B1 interlaces with warps 2 and 12 while the adjacent weft B2 interlaces with warps 6 and 16 such that the warps interlacing with adjacent wefts are separated by a single warp yarn i.e. the "stepping" sequence wearside fabric warp yarn knuckles always moves by 2 warp yarns when moving from one contiguous wearside weft to another. Accordingly the wear side structure is a five shaft sateen weave. On the paper side the interlacing of the warp and wefts in "over-one and under-one" arrangement identifies a so-called plain weave structure.

Figure 2:
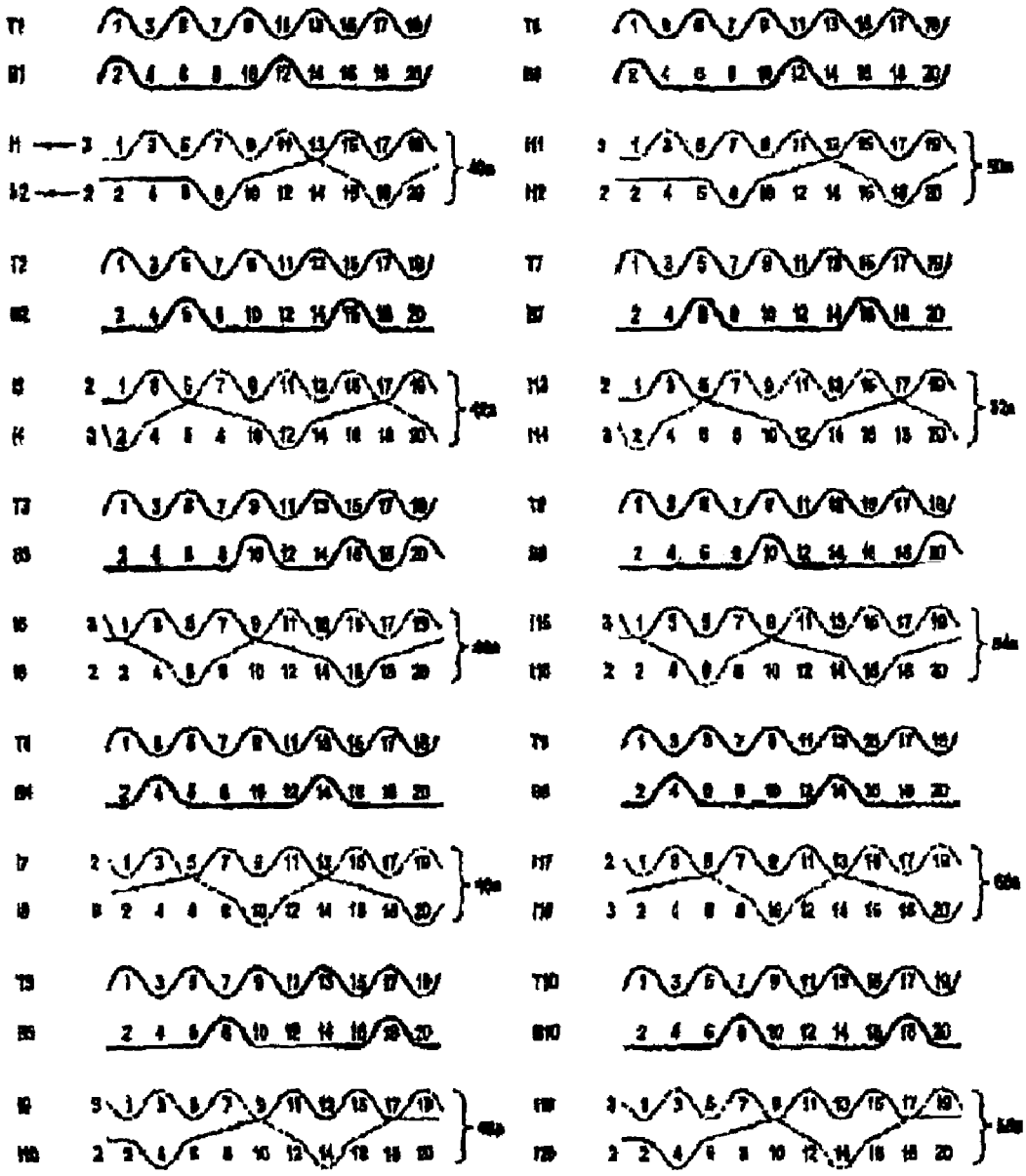
FIG. 2 is a series of warp cross sectional diagrams showing consecutive weft paths of a first fabric in accordance with the present invention.

Referring to FIG. 2 a triple layer forming fabric in accordance with the invention has a twenty warp yarn repeat wherein warp yarns 1, 3, 5 . . . 19 are paper side warp yarns and warp yarns 2, 4, 6 . . . 20 are wearside warp yarns. The fabric of FIG. 2 also contains a forty weft repeat. The wefts comprise paper side or top wefts T1, T2, T3 . . . T10, wear side or bottom wefts B1, B2, B3 . . . B10 and interchanging binder weft pairs 40A, 42A, 44A . . . 58A. In FIG. 2 interchanging yarns I1 and I2 are both binder yarns in the pair 40A and interlace respectively with warp yarns 18 and 8 of the wear side fabric. Both binder yarns are positioned between wear side wefts B1 and B2. However, unlike the prior art, the Interlacing of weft B1 with the wearside warp 12, and weft B2 with warp 16 does not act to "lock" binder I1 in position. Instead interchanging binder I1 remains unlocked where it binds under warp 18 because, although contiguous with interlacing of B2 and warp 16 on one side, there is no locking wearside weft-warp knuckle on the remaining side. Similarly the interlacing of weft B1 with warps 2 and weft B2 with warp 6 does not act to lock binder I2 in position. The nature of the binding arrangement of interchanging binders I1 and I2 is representative of the other binder pairs, as can be seen in FIG. 2, so these are not described further. The interlacings of the respective wear side wefts and warps act to form a five shaft wear side fabric with the characteristic weft under four adjacent warps and over one warp arrangement as has been described with reference to FIG. 1 and other features such that the wear side structure is a five shaft sateen weave. On the paper side the interlacing of the warp and wefts in "over-one and under-one" arrangement identifies a so-called plain weave structure.

In fabrics of the invention made according to FIG. 2 it was found, when testing with a two-point bending stiffness tester, that such fabric had an increase in CD bending stiffness of 25% when compared to fabric made according to FIG. 1.

A high value for fabric CD bending stiffness is desirable to increase the fabric ability to minimize sheet basis weight profiles. Fabric according to FIG. 2 may allow some movement of the binder yarns such that they may ride at least partially on an adjacent wear side weft yarn, as indicated by a thickness increase of 2.4% compared to fabric according to FIG. 1, such that bending resistance increases.

The full details for the fabric according to FIGS. 1 and 2 are given in Table 1.

TABLE 1

| Weave Pattern | Prior Art FIG. 1 | Invention FIG. 2 |
|---|---|---|
| Yarn Diameter (mm) | | |
| Paperside MD/CD | 0.12/0.13 | 0.12/0.13 |
| wearside MD/CD | 0.15/0.20 | 0.15/0.20 |
| Binders | 0.13 | 0.13 |
| Yarns/cm* | | |
| Paperside MD/CD | 38.0/39.5 | 38.0/39.5 |
| wearside MD/CD | 38.0/19.7 | 38.0/19.7 |
| Bending Stiffness Ratio | 100 | 125 |
| Thickness (mm) | 0.700 | 0.718 |
| Permeability (cfm) | 358 | 376 |

*binder pairs counted as single paper side wefts

In FIG. 2 all binders are shown in "unlocked" positions. However, some benefits may be obtained from fabrics where only some binders are in the unlocked position in the wear side fabric and some binders are in a locked position on the fabric wear side. In one embodiment at least 25% of the binder pairs interlace with the machine side warp yarns. Furthermore suitable fabric has been obtained where one member of the binder pair interlaces with the machine side warp yarn.

In FIG. 2 the ratio of paper side to wear side welt yarns, when counting a binder pair as equal to a single paper side welt pair is shown as 2:1. However, fabric in accordance with the invention can also be made with an "effective" paper side to wear side CD ratio of 1:1, 3:2, 4:3, 5:3 and so forth as has been stated. Similarly, machine warp yarns with ratios of 1:1, 2:1, 3:2, 4:3, or 5:3 can make a suitable fabric.

It is to be understood that the above described embodiment is by way of illustration only. Many modifications and variations are possible.

The invention claimed is:

1. A paper machine fabric having a paper side warp layer and a machine side warp layer, the fabric comprising at least one set of paper side weft yarns interlaced with paper side warp yarns, at least one set of machine side weft yarns interlaced with machine side warp yarns, and at least one pair of interchanging weft binder yarns, the members of each weft binder pair forming together one continuous weft path on the paper side, all of said weft binder pairs interweaving with at least one paper side warp and at least one machine side warp, wherein at least one weft binder yarn member of each binder pair interlaces with machine side warp yarns in an unlocked position.

2. A paper machine fabric as claimed in claim 1, wherein all weft binder yarn members of all binder pairs interlace with machine side warp yarns in unlocked positions.

3. A paper machine fabric as claimed in claim 1, wherein at least one weft binder yarn member of at least 25% of the binder pairs interlaces with machine side warp yarns in unlocked positions.

4. A paper machine fabric as claimed in claim 1, wherein the paper side weave pattern is plain weave.

5. A paper machine fabric as claimed in claim 1, wherein the machine side weave pattern comprises one of, 5, 7, 8, or 10 shaft regular sateen.

6. A paper machine fabric as claimed in claim 1, wherein the ratio of paper side to machine side weft yarns, when counting a pair of interchanging wefts as a single paper side weft, comprises one of, 1:1, 2:1, 3:2, 4:3, or 5:3.

7. A paper machine fabric as claimed in claim 1, wherein the ratio of paper side to machine side warp yarns comprises one of, 1:1, 2:1, 3:2, 4:3, or 5:3.

8. A paper machine fabric as claimed in claim 1, wherein all non-interchanging paper side weft yarns are distributed in groups of one paper side weft and each group is separated by a pair of interchanging weft binders.

9. A paper machine fabric as claimed in claim 1, wherein all non-interchanging paper side weft yarns are distributed in groups of two paper side wefts and each group is separated by a pair of interchanging weft binders.

10. A paper machine fabric as claimed in claim 1, wherein all non-interchanging paper side weft yarns are distributed in equal sized groups of at least three paper side wefts and each group is separated by a pair of interchanging weft binders.

11. A paper machine fabric as claimed in claim 1, wherein non-interchanging paper side weft yarns are distributed in groups of at least two different sizes and each group is separated by a pair of interchanging weft binders.

12. A paper machine fabric as claimed in claim 1, wherein interchanging weft binder pairs are less numerous than the non-interchanging paper side wefts.

13. A paper machine fabric as claimed in claim 1, wherein interchanging weft binder pairs are present in equal number to the non-interchanging paper side wefts.

14. A paper machine fabric as claimed in claim 1, wherein interchanging weft binder pairs are more numerous than the non-interchanging paper side wefts.

15. A method of making paper, said method comprising:

i) providing a paper machine fabric having a paper side warp layer and a machine side warp layer, the fabric comprising at least one set of paper side weft yarns interlaced with paper side warp yarns, at least one set of machine side weft yarns interlaced with machine side warp yarns, and at least one pair of interchanging weft binder yarns, the members of each weft binder pair together forming one continuous weft path on the paper side, all of said weft binder pairs interweaving with at least one paper side warp and at least one machine side warp, and at least one weft binder yarn member of each binder pair interlacing with machine side warp yarns in an unlocked position;

ii) depositing paperstock on the papermaking side of said paper machine fabric; and iii) dewatering said paperstock through said paper machine fabric.

* * * * *